US010658754B2

(12) United States Patent
Ravishankar

(10) Patent No.: US 10,658,754 B2
(45) Date of Patent: May 19, 2020

(54) ANTENNA ARRAY INCLUDING SUPPRESSOR

(71) Applicant: QUALCOMM Incorporated, San Diego, CA (US)

(72) Inventor: Arjun Ravishankar, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 50 days.

(21) Appl. No.: 16/146,432

(22) Filed: Sep. 28, 2018

(65) Prior Publication Data

US 2020/0106182 A1 Apr. 2, 2020

(51) Int. Cl.

| | |
|---|---|
| ***H01Q 9/04*** | (2006.01) |
| ***H01Q 21/06*** | (2006.01) |
| ***H01Q 1/38*** | (2006.01) |
| ***H01Q 9/40*** | (2006.01) |

(52) U.S. Cl.

CPC ..... *H01Q 9/0407* (2013.01); *H01Q 1/38* (2013.01); *H01Q 9/40* (2013.01); *H01Q 21/065* (2013.01)

(58) Field of Classification Search

CPC ..... H01Q 9/0407; H01Q 1/38; H01Q 9/40; H01Q 21/065

See application file for complete search history.

(56) References Cited

U.S. PATENT DOCUMENTS

| | | | |
|---|---|---|---|
| 8,004,466 | B2 | 8/2011 | Kim et al. |
| 9,806,425 | B2 | 10/2017 | Apostolos et al. |
| 2011/0260925 | A1 | 10/2011 | Chirila |

FOREIGN PATENT DOCUMENTS

| | | | |
|---|---|---|---|
| CN | 201199544 | Y | 2/2009 |

OTHER PUBLICATIONS

Sengupta K., et al., "Designing Optimal Surface Currents for Efficient on-Chip mm-Wave Radiators with Active Circuitry", IEEE Transactions on Microwave Theory and Techniques, Jul. 2016, vol. 64, No. 7, pp. 1976-1988.

*Primary Examiner* — Graham P Smith

(74) *Attorney, Agent, or Firm* — Hunter Clark PLLC

(57) ABSTRACT

A millimeter-wave antenna system includes: an array of radiators comprising a first radiator and a second radiator, each of the first radiator and the second radiator being configured to radiate millimeter-wave energy; and an insulator disposed at least partially between the first radiator and the second radiator and disposed and configured to intercept first near-field energy radiated by the first radiator to inhibit the first near-field energy from being received by the second radiator, and to intercept second near-field energy radiated by the second radiator to inhibit the second near-field energy from being received by the first radiator, the insulator being configured to reflect the first near-field energy away from the first radiator and away from the second radiator and to reflect the second near-field energy away from the first radiator and away from the second radiator.

24 Claims, 5 Drawing Sheets

ANTENNA ARRAY INCLUDING SUPPRESSOR

BACKGROUND

Wireless communication devices are increasingly popular and increasingly complex. For example, mobile telecommunication devices have progressed from simple phones, to smart phones with multiple communication capabilities (e.g., multiple cellular communication protocols, Wi-Fi, BLUETOOTH® and other short-range communication protocols), supercomputing processors, cameras, etc. Wireless communication devices have antennas to support communication over a range of frequencies.

As wireless communication technology evolves, mobile communication devices may be configured to communicate using multiple millimeter-wave, e.g., above 25 GHz, beams. Millimeter-wave receive (Rx) beams may align with a transmit (Tx) beam of a 5G base station, that may be referred to as a gNodeB, or gNB, or a WLAN access point, or other source of communication signals. The receive beams may be from a Pseudo-Omni (PO) codebook (i.e., the range and granularity of steering angles), with a relatively large beamwidth, or may be from a narrow codebook, with a relatively small beamwidth. To form beams of varying beamwidths (e.g., narrower beamwidth for data transmission), different antenna array elements types and arrangements may be used. By changing antenna array element weights (signal amplitudes and/or input feed signal phases), beams can be steered to various different scan angles and/or switched between a PO beam and a narrower beam.

SUMMARY

An example of a millimeter-wave antenna system includes: an array of radiators comprising a first radiator and a second radiator, each of the first radiator and the second radiator being configured to radiate millimeter-wave energy; and an insulator disposed at least partially between the first radiator and the second radiator and disposed and configured to intercept first near-field energy radiated by the first radiator to inhibit the first near-field energy from being received by the second radiator, and to intercept second near-field energy radiated by the second radiator to inhibit the second near-field energy from being received by the first radiator, the insulator being configured to reflect the first near-field energy away from the first radiator and away from the second radiator and to reflect the second near-field energy away from the first radiator and away from the second radiator.

Implementations of such a system may include one or more of the following features. The insulator comprises a first surface having a first bottom edge and a second surface having a second bottom edge, the first surface extending from the first bottom edge away from a plane connecting a top of the first radiator and a top of the second radiator and extending away from a center of the first radiator, the second surface extending from the second bottom edge away from the plane connecting the top of the first radiator and the top of the second radiator and extending away from a center of the second radiator. The first surface is flat and the second surface is flat. The first surface extends away from the plane by a least a quarter of a wavelength of the millimeter-wave energy. The first radiator extends a first length transverse to a center-to-center direction between a center of the first radiator and a center of the second radiator, wherein the second radiator extends a second length transverse to the center-to-center direction, and wherein the insulator extends, transverse to the center-to-center direction, at least half of the first length and at least half of the second length.

Also or alternatively, implementations of such a system may include one or more of the following features. The insulator overlaps a projection of the first radiator, along boresight of the first radiator, by less than half of an area of the projection. The insulator overlaps none of the projection of the first radiator along boresight of the first radiator. The array of radiators includes an array of patch radiators, and the system further includes a ground plane displaced from and disposed below the array of patch radiators, and wherein the insulator extends above the array of patch radiators. The array of patch radiators includes a plurality of rows of the patch radiators and a plurality of columns of the patch radiators, and wherein the insulator comprises at least a first strip of dielectric material disposed between two of the plurality of rows of the array of patch radiators and at least a second strip of dielectric material disposed between two of the plurality of columns of the array of patch radiators. The first radiator and the second radiator have a center-to-center spacing of less than a half of a wavelength of the millimeter-wave energy.

Another example of a millimeter-wave antenna system includes: an array of planar radiators arranged in at least one row, each of the planar radiators being configured to radiate millimeter-wave energy; a ground plane displaced from the array of planar radiators in a first direction; and a suppressor comprising a respective strip of dielectric disposed between each pair of neighbor radiators of the array of planar radiators; where each strip of dielectric extends in a second direction away from the array of planar radiators, the second direction being opposite the first direction.

Implementations of such a system may include one or more of the following features. Each strip of dielectric includes a plurality of flat surfaces, a normal to each of the plurality of flat surfaces being directed away from the ground plane and toward a volume above a nearest one of the array of planar radiators. The array of planar radiators are arranged in a plurality of rows and a plurality of columns, and the suppressor includes the respective strip of dielectric disposed between each pair of neighbor radiators of neighboring rows of the array of planar radiators and between each pair of neighbor radiators of neighboring columns of the array of planar radiators. The suppressor includes a grid of the dielectric. Each strip of dielectric extends, along a plane of the planar radiators, at least half of a length of a nearest edge of each neighbor radiator of a respective pair of neighbor radiators. The suppressor is configured to inhibit near-field coupling between each pair of neighbor radiators.

An example of a method of reducing near-field coupling between radiators includes: radiating millimeter-wave energy from an array of radiators including a first radiator and a second radiator that is a neighbor of the first radiator; redirecting, using an insulator, near-field energy radiated by the first radiator, that absent the insulator would couple to the second radiator, away from the second radiator.

Implementations of such a method may include one or more of the following features. The redirecting includes reflecting at least some of the near-field energy from a surface of the insulator that is angled away from boresight of the first radiator. The near-field energy is first near-field energy, and the surface of the insulator is a first surface of the insulator, and the method may include redirecting, using the insulator, second near-field energy radiated by the second radiator, that absent the insulator would couple to the first radiator, away from the first radiator by reflecting at least some of the second near-field energy from a second surface of the insulator that is angled away from boresight of the second radiator. The array of radiators includes a two-dimensional array of radiators, and wherein the redirecting comprises redirecting near-field energy radiated by each radiator of the array of radiators away from each neighbor radiator of the array of radiators using the insulator.

Another example of a millimeter-wave antenna system includes: a planar array of radiators arranged in at least one row, each of the radiators being configured to radiate millimeter-wave energy, the planar array of radiators including a first radiator and a second radiator that is neighbor of the first radiator; and means for redirecting near-field energy radiated by the first radiator, that absent the means for redirecting would couple to the second radiator, away from the second radiator.

Implementations of such a system may include one or more of the following features. The means for redirecting includes a wedge-shaped dielectric. The means for redirecting extends at least a quarter of a wavelength, at a frequency of the millimeter-wave energy, away from a plane of the planar array of radiators. The means for redirecting extends, along a plane of the planar radiators, at least half of a length of a nearest edge of each neighbor radiator of a respective pair of neighbor radiators of the planar array of radiators.

DETAILED DESCRIPTION

Figure 1:
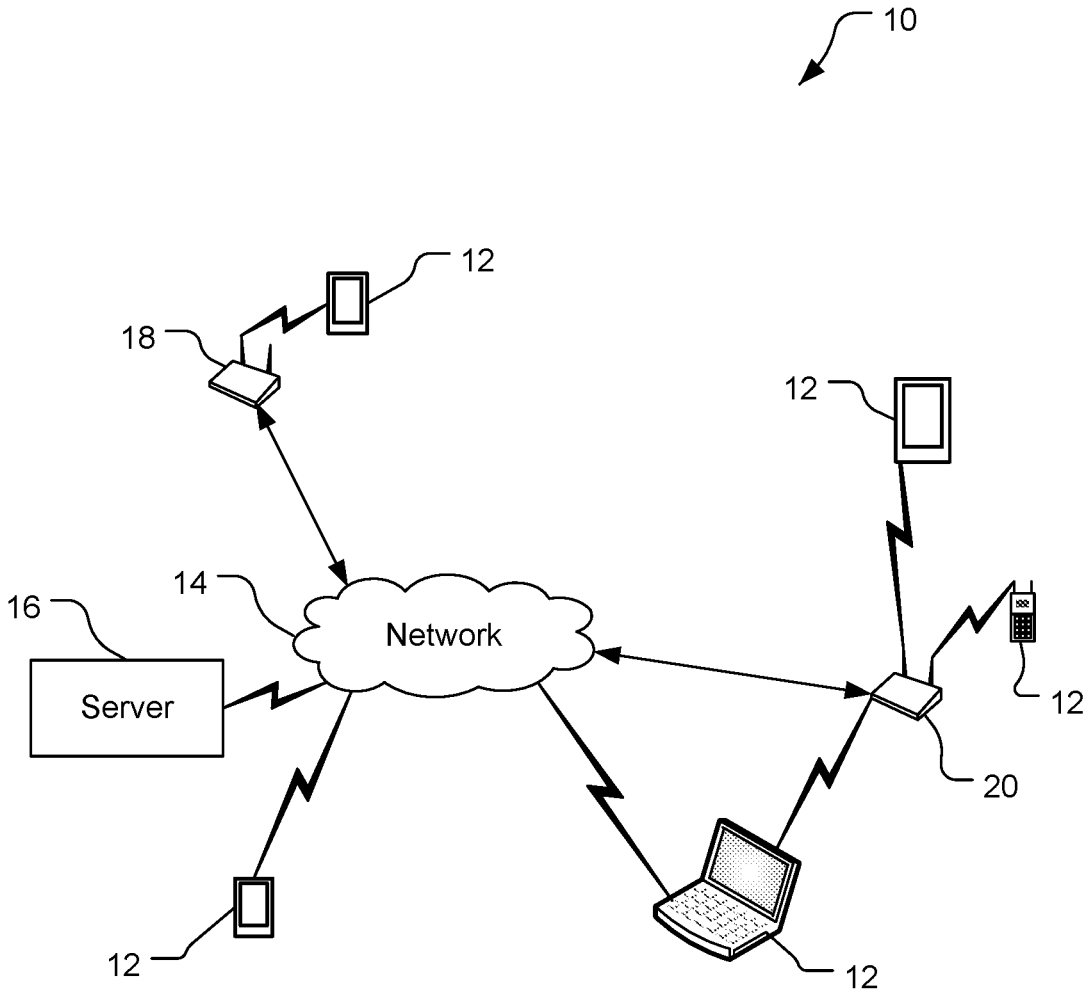
FIG. 1 is a schematic diagram of a communication system.

Multiple radiators may be used for wireless communications at one or more millimeter-wave frequencies, e.g., to achieve desired gain and/or steerability, which may result in coupling between radiators. For example, radiated energy may coupled between radiators, especially neighboring radiators, with energy radiated by one radiator being received by another radiator. Such coupling may degrade the performance of the radiators, e.g., negatively affecting beam forming. The radiators may couple to each other through near-field radiative coupling when the electric field $\vec{E}$ and/or the magnetic field $\vec{H}$ from one radiator interferes with one or more of these fields of another of the radiators. The near-field radiative coupling may reduce range of scanning (i.e., degrade steerability), yield inconsistent PO/narrow beam formation, and/or reduce array gain, and/or have one or more other effects.

Techniques are discussed herein for radiating in millimeter-wave frequency bands (e.g., for communication), for example while mitigating near-field radiative coupling between radiators. For example, a planar array of patch radiators may have an insulator disposed between each pair of radiators in the array that are next to each other, e.g., in the same row and consecutive columns or in the same column and consecutive rows. The insulator may comprise a material to absorb millimeter wave energy that enters the insulator. The insulator may be shaped to impede near-field radiative energy from one radiator in a pair from reaching the other radiator in the pair. For example, the insulator may be wedge-shaped and may protrude with respect to a surface of the radiators to help reflect incident near-field radiative energy. Other configurations, however, may be used.

Items and/or techniques described herein may provide one or more of the following capabilities, as well as other capabilities not mentioned. Communication using millimeter-wave frequency bands of a wireless communication device may be provided with good isolation between radiators and with good antenna performance. Near-field coupling between neighbor radiators in an array of radiators may be reduced and antenna performance improved. Sharper, narrower beams may be provided, e.g., from a radiator array. Far-field energy from a radiator array may be increased. Transmit power used by a radiator array may be reduced while still meeting a link budget. More flexibility in array steering may be provided, which may help in scanning a wider range of angles more accurately, yielding an improved, e.g., bigger, codebook. Inter-element spacing of a radiator array may be reduced, e.g., below a quarter wavelength at a radiating frequency. Radiators may be more densely populated in an array, yielding an array with more radiators for a similar area, which may result in improved array performance, e.g., higher gain. Near-field coupling in an array may be reduced by a device that fits within a form factor of the array and is a one-time cost. Other capabilities may be provided and not every implementation according to the disclosure must provide any, let alone all, of the capabilities discussed. Further, it may be possible for an effect noted above to be achieved by means other than that noted, and a noted item/technique may not necessarily yield the noted effect.

Referring to FIG. 1, a communication system 10 includes mobile devices 12, a network 14, a server 16, and access points (APs) 18, 20. The system 10 is a wireless communication system in that components of the system 10 can communicate with one another (at least some times using wireless connections) directly or indirectly, e.g., via the network 14 and/or one or more of the access points 18, 20 (and/or one or more other devices not shown, such as one or more base transceiver stations). For indirect communications, the communications may be altered during transmission from one entity to another, e.g., to alter header information of data packets, to change format, etc. The mobile devices 12 shown are mobile wireless communication devices (although they may communicate wirelessly and via wired connections) including mobile phones (including smartphones), a laptop computer, and a tablet computer. Still other mobile devices may be used, whether currently existing or developed in the future. Further, other wireless devices (whether mobile or not) may be implemented within the system 10 and may communicate with each other and/or with the mobile devices 12, network 14, server 16, and/or APs 18, 20. For example, such other devices may include internet of thing (IoT) devices, medical devices, home entertainment and/or automation devices, etc. The mobile devices 12 or other devices may be configured to communicate in different networks and/or for different purposes (e.g., 5G, Wi-Fi communication, multiple frequencies of Wi-Fi communication, satellite positioning, one or more types of cellular communications (e.g., GSM (Global System for Mobiles), CDMA (Code Division Multiple Access), LTE (Long-Term Evolution), etc.). The mobile device 12 is commonly referred to as a user equipment (UE) in UMTS (Universal Mobile Telecommunications System) applications, but may also be referred to as a mobile station (MS), a subscriber station, a mobile unit, a subscriber unit, a wireless unit, a remote unit, a mobile device, a wireless device, a wireless communications device, a remote device, a mobile subscriber station, an access terminal (AT), a mobile terminal, a wireless terminal, a remote terminal, a handset, a terminal, a user agent, a mobile client, a client, or some other suitable terminology.

Figure 2:
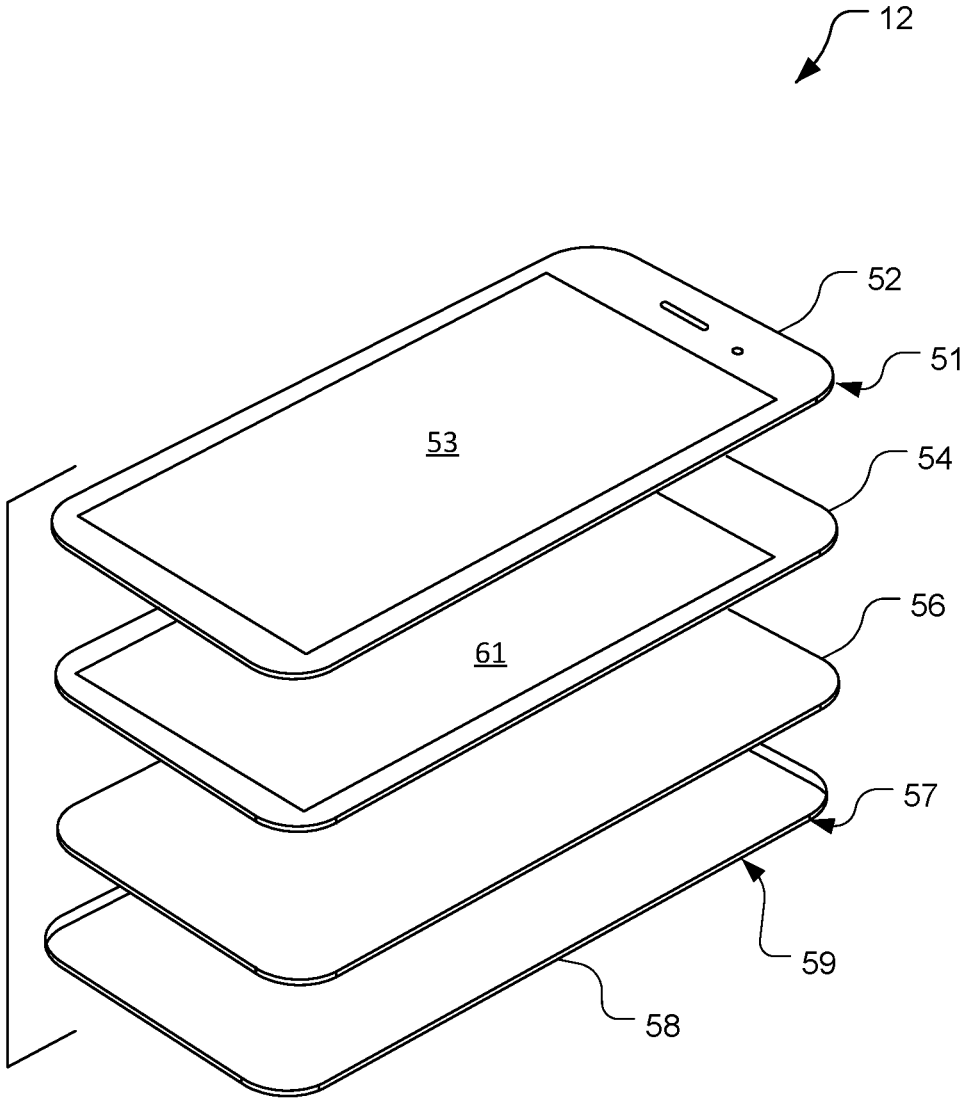
FIG. 2 is an exploded perspective view of simplified components of a mobile device shown in FIG. 1.

Referring to FIG. 2, an example of one of the mobile devices 12 shown in FIG. 1 includes a top cover 52, a display layer 54, a printed circuit board (PCB) layer 56, and a bottom cover 58. The mobile device 12 as shown may be a smartphone or a tablet computer but the discussion is not limited to such devices. The top cover 52 includes a screen 53. The PCB layer 56 includes one or more antennas configured to facilitate bi-directional communication between mobile device 12 and one or more other devices, including other wireless communication devices. The bottom cover 58 has a bottom surface 59 and sides 51, 57 of the top cover 52 and the bottom cover 58 provide an edge surface. The top cover 52 and the bottom cover 58 may comprise a housing that retains the display layer 54, the PCB layer 56, and other components of the mobile device 12 that may or may not be on the PCB layer 56. For example, the housing may retain (e.g., hold, contain) antenna systems, front-end circuits, an intermediate-frequency circuit, and a processor discussed below. Further, the size and/or shape of the PCB layer 56 may not be commensurate with the size and/or shape of either of the top or bottom covers or otherwise with a perimeter of the device. For example, the PCB layer 56 may have a cutout to accept a battery. Those of skill in the art will therefore understand that embodiments of the PCB layer 56 other than those illustrated may be implemented.

Figure 3:
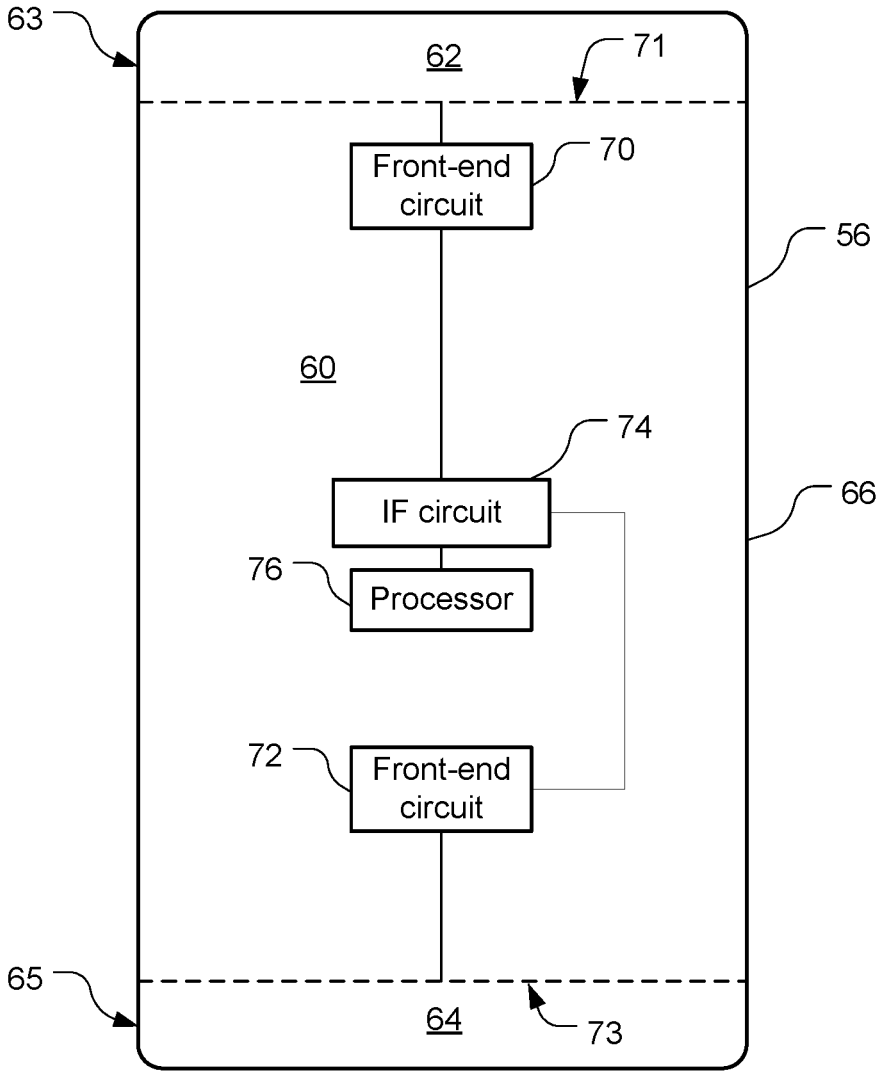
FIG. 3 is a top view of a printed circuit board layer, shown in FIG. 2, including antenna systems.

Referring also to FIG. 3, an example of the PCB layer 56 includes a main portion 60 and two antenna systems 62, 64. In the example shown, the antenna systems 62, 64 are disposed at opposite ends 63, 65 of the PCB layer 56, and thus, in this example, of the mobile device 12 (e.g., of the housing of the mobile device 12). The main portion 60 may comprise a PCB 66 that includes front-end circuits 70, 72 (also called a radio frequency (RF) circuit), an intermediate-frequency (IF) circuit 74, and a processor 76. The front-end circuits 70, 72 are configured to provide signals to be radiated to the antenna systems 62, 64 and to receive and process signals that are received by, and provided to the front-end circuits 70, 72 from, the antenna systems 62, 64. The front-end circuits 70, 72 are configured to convert received IF signals from the IF circuit 74 to RF signals (amplifying with a power amplifier as appropriate), and provide the RF signals to the antenna systems 62, 64 for radiation. The front-end circuits 70, 72 are configured to convert RF signals received by the antenna systems 62, 64 to IF signals (e.g., using a low-noise amplifier and a mixer) and to send the IF signals to the IF circuit 74. The IF circuit 74 is configured to convert IF signals received from the front-end circuits 70, 72 to baseband signals and to provide the baseband signals to the processor 76. The IF circuit 74 is also configured to convert baseband signals provided by the processor 76 to IF signals, and to provide the IF signals to the front-end circuits 70, 72. The processor 76 is communicatively coupled to the IF circuit 74, which is communicatively coupled to the front-end circuits 70, 72, which are communicatively coupled to the antenna systems 62, 64, respectively.

The antenna systems 62, 64 may be formed as part of the PCB layer 56 in a variety of manners. In FIG. 3, dashed lines 71, 73 separating the antenna systems 62, 64 from the PCB 66 indicate functional separation of the antenna systems 62, 64 (and the components thereof) from other portions of the PCB layer 56. The antenna systems 62, 64 may be integral with the PCB 66, being formed as integral components of the PCB 66 or may be separate from, but attached to, the PCB 66. Alternatively, one or more components of the antenna system 62 and/or the antenna system 64 may be formed integrally with the PCB 66, and one or more other components may be formed separate from the PCB 66 and mounted to the PCB 66, or otherwise made part of the PCB layer 56. Alternatively, each of the antenna systems 62, 64 may be formed separately from the PCB 66 and mounted to the PCB 66 and coupled to the front-end circuits 70, 72, respectively. In some embodiments, one or both of the front-end circuits 70, 72 are implemented with the antenna system 62 or 64 in a module and coupled to the PCB 66. For example, the module may be mounted to the PCB 66 or may be spaced from the PCB 66 and coupled thereto, for example using a flexible cable or a flexible circuit. The antenna systems 62, 64 may be configured similarly to each other or differently from each other. For example, one or more components of either of the antenna systems 62, 64, may be omitted. As an example, the antenna system 62 may include 4G and 5G radiators while the antenna system 64 may not include (may omit) a 5G radiator. In other examples, an entire one of the antenna systems 62, 64 may be omitted or may be configured for use with a non-cellular technology such as a WLAN technology.

A display 61 (see FIG. 2) of the display layer 54 may roughly cover the same area as the PCB 66 and serve as a system ground plane for the antenna systems 62, 64 (and possibly other components of the device 12). The display 61 is disposed below the antenna system 62 and above the antenna system 64 (with "above" and "below" being relative to the mobile device 12, i.e., with a top of the mobile device 12 being above other components regardless of an orientation of the device 12 relative to the Earth).

The antenna systems 62, 64 may be configured to transmit and receive millimeter-wave energy. The antenna systems 62, 64 may be configured to steer to different scan angles and/or to change size of beamwidth, e.g., between a PO beam and a narrower beam.

Figure 4:
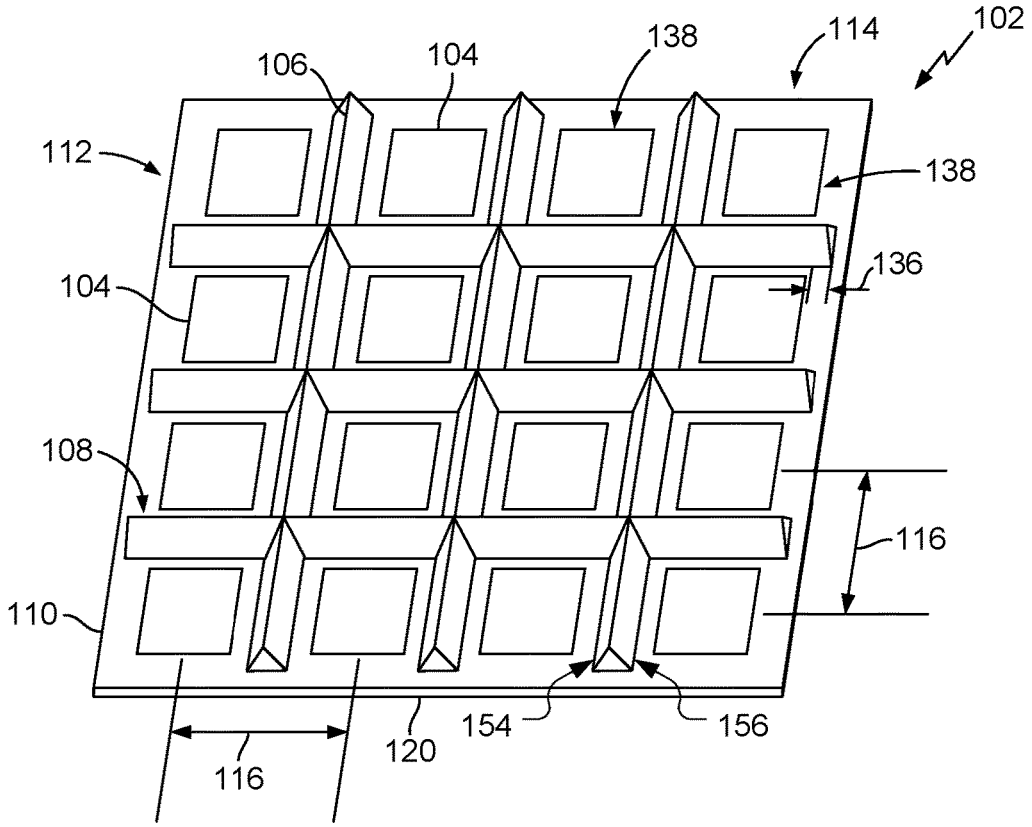
FIG. 4 is a perspective view of an example radiator array of one of the antenna systems shown in FIG. 3.
Figure 5:
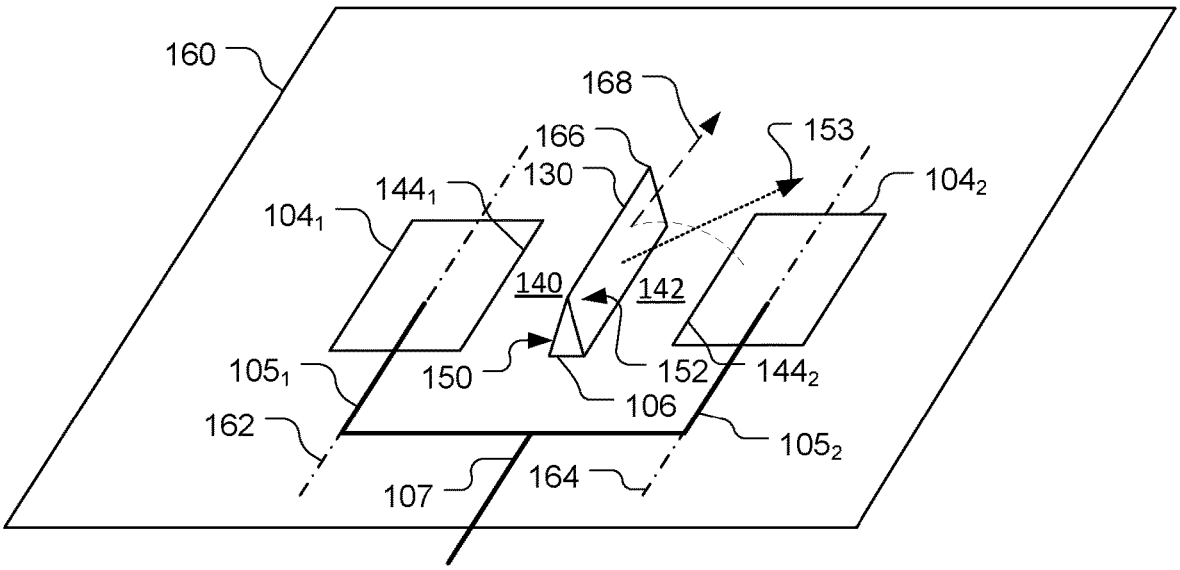
FIG. 5 is a simplified top perspective view of portion of the radiator array shown in FIG. 4.

Referring also to FIGS. 4-5, a radiator array 102, which is an example of a portion of the antenna system 62, e.g., for use in wireless communication, includes a planar array of radiators 104 and a near-field suppressor 106. While here the radiator array 102 is a planar array, a non-planar array may be used, e.g., non-planar radiators may be used, such as parabolic radiators or dipole radiators. The radiator array 102 is configured such that near-field radiative coupling between neighboring ones of the radiators 104 is reduced compared to the suppressor 106 being absent. The presence of the suppressor reduces the coupling and improves the performance of the planar array 102 of the radiators 104. Energy is provided to the radiators 104 by feed lines. For example, radiators $\mathbf{104}_1$, $\mathbf{104}_2$ shown in FIG. 5 are provided energy from feed lines $\mathbf{105}_1$, $\mathbf{105}_2$, respectively, that are each feed by a common feed line 107. The feed lines $\mathbf{105}_1$, $\mathbf{105}_2$ feed the radiators $\mathbf{104}_1$, $\mathbf{104}_2$ along the centerlines 162, 164 of the radiators $\mathbf{104}_1$, $\mathbf{104}_2$ in this example, although other feed configurations may be used. Further, while a single feed line per radiator is illustrated, multiple feed lines may be coupled to each radiator, for example such that each of the radiators emits energy with multiple polarizations. In addition, while the feed lines 105$_1$, 105$_2$ are illustrated as being directly coupled to the common feed line 107, in some embodiments one or more elements may be situated between the radiators 104$_1$, 104$_2$ and the common feed line 107, for example amplification and/or phase adjustment circuitry or components.

In the example shown in FIG. 4, the radiators 104 are patch radiators disposed in a common plane, e.g., on a top, planar, surface 108 of a substrate 110, in a two-dimensional array. The radiators 104 are disposed in four rows 112 and four columns 114. These quantities of rows 112 and columns 114 are examples only and other quantities may be used. For example, a single row or a single column may be used. The quantities of rows and columns may be inequal.

The radiators 104 shown in the example of FIG. 4 are square and the rows 112 and columns 114 are evenly spaced such that the radiator array 102 is square. A center-to-center spacing 116 of neighboring ones of the radiators 104 between rows 112 and columns 114 is about a half a wavelength (e.g., 0.5λ±10%) of the millimeter-wave energy radiated by the radiators 104, or less, e.g., to avoid the introduction of grating lobes while fitting within space limitations of mobile devices. The spacing 116 may be as small as about a quarter of the wavelength or even smaller. Neighbor radiators 104 are not adjacent or abutting, but are separated by the suppressor 106, which is discussed further below. The separation of the neighbor radiators 104 may vary depending on the size of the radiators 104. Neighbor radiators 104 have no other radiator between them (i.e., they are consecutive radiators in one of the rows 112 or one of the columns 114). Here the center-to-center spacing 116 between neighbor rows 112 and neighbor columns 114 is the same, but different spacing values between rows and between columns could be used. Further, non-square radiators could be used, e.g., rectangles with different length sides for radiating different frequencies. Still other shapes of radiators and/or other layouts of radiators may be used, e.g., circular radiators, non-uniform spacing of radiators, different row and column spacing of radiators, an array with rows of radiators offset with respect to each other, etc.

The radiators 104 are each configured to radiate millimeter-wave energy. For example, the radiators 104 may be configured to radiate millimeter-wave signals implementing a 5G standard, a WLAN standard (e.g., 802.11ad and/or 802.11ay), and/or another standard which utilizes signals in the millimeter-wave spectrum. In some embodiments, the radiators 104 radiate at a frequency of approximately 28 GHz, 39 GHz, 60 GHz, and/or 71 GHz or higher.

The radiators 104 may be fed to radiate in two polarizations, making the radiators 104 dual-polarization radiators. Because the radiators 104 in this example are rectangular (here, squares), the two polarizations are transverse to each other. Neighboring edges of the radiators 104, i.e., edges of neighbor radiators 104 that are closest to each other are parallel. Indeed, in the example shown, each radiator edge is either parallel or perpendicular to the other edges of that radiator 104 and of the other radiators 104.

Further, the planar array 102 of the radiators 104 includes a ground plane 120 disposed below the radiators 104. The ground plane 120 is disposed on a bottom of the substrate 110, on an opposite surface of the substrate 110 from the radiators 104. The ground plane 120 is configured and disposed to reflect energy radiated toward the ground plane 120 by the radiators 104 to constructively interfere with energy radiated away from the ground plane 120 by the radiators 104.

The suppressor 106 may be configured to suppress near-field radiation from one radiator 104 from reaching and coupling to a neighbor radiator 104. Near-field coupling between the radiators 104 may increase the beamwidth, with the suppressor 106 thus reducing the beamwidth compared to the absence of the suppressor 106. Further, a mainbeam (e.g., comprising energy from multiple radiators constructively and destructively interfering) may be steered to a wider angle from boresight using the suppressor 106 before a grating lobe will be produced compared to the absence of the suppressor 106. The suppressor 106 may also or alternatively increase gain of the planar array 102 which, for a fixed distance between the planar array 102 and another device, may allow a lower transmit power to be used while meeting link budget, e.g., an RACH (Random Access Channel) link budget. The shape and/or layout of the suppressor may depend on the shape(s) and/or layout of radiators, e.g., with suppressor shape being reflective of radiator shape (e.g., a honeycomb-shaped suppressor for an array of circular radiators). The shape of the suppressor may be chosen such that the suppressor is disposed near the edge(s) of the radiators, in particular between the edge(s) of neighboring radiators.

As shown in FIG. 4, the suppressor 106 is configured to fit into the form factor of the array of the radiators 104. Here, the suppressor is configured as a grid and disposed such that a portion of the suppressor 106 is disposed between each pair of neighbor radiators 104. While the suppressor 106 is shown in FIG. 4 as a contiguous grid, other configurations may be used. For example, the suppressor 106 may comprise multiple, separate pieces. Each pair of neighbor radiators 104 may be separated by a strip 130 (see FIG. 5) of the suppressor 106, with the strip 130 extending along a plane 160 of the planar array 102 at least half of a length of a nearest edge of each neighbor radiator 104. That is, the radiator 104$_1$ extends an edge length transverse to a center-to-center direction between a center of the radiator 104$_1$ and a center of the radiator 104$_2$, and the radiator 104$_2$ extends another edge length (which may be the same as the other edge length) transverse to the center-to-center direction, and the suppressor 106 extends, transverse to the center-to-center direction, at least half of each of the edge lengths. The suppressor 106 overlaps, projecting the suppressor 106 parallel to the center-to-center spacing, at least half of each of the nearest radiator edge lengths. As shown in FIG. 5, the strip 130 extends the full length of edges 144$_1$, 144$_2$ of radiators 104$_1$, 104$_2$ that are nearest to the strip 130. The suppressor 106 may extend beyond outer edges of the radiators 104 at the outside of the planar array 102. For example, the suppressor may extend a distance 136 of about a wavelength, of the radiated millimeter-wave energy, beyond outer edges 138 of outer-edge radiators of the radiators 104. As shown, the suppressor 106 may be disposed in the middle between neighbor radiators 104, although the suppressor 106 may be disposed closer to one neighbor radiator 104 than the other. The suppressor 106 as shown is spaced apart from the nearest edges of the neighbor radiators 104 between which the suppressor 106 is disposed. That is, there are gaps 140, 142 between the suppressor strip 130 and the edges 144$_1$, 144$_2$, of the radiators 104$_1$, 104$_2$, respectively. The gaps 140, 142 may have the same or different widths (i.e., separations of the strip 130 and the respective radiators 104$_1$, 104$_2$). In other configurations, one or more of the gaps 140, 142 may not exist such that the strip 130 of the suppressor 106 abuts or even partially overlaps at least one of the neighbor radiators 104. Thus, the suppressor 106 may overlap a projection of a radiator 104, along boresight of the radiator 104, but may do so by less than half of an area of the projection of the radiator 104, if at all. The suppressor may overlap none of such a projection of the radiator 104.

The suppressor 106 (or other equivalent structure and/or material) may comprise means for redirecting near-field energy radiated by one radiator, that absent the suppressor 106 would couple to at least one other radiator 104, away from the other radiator 104. As may be better seen in FIG. 5, in this example, the suppressor 106 is configured to be wedge-shaped, with each section, e.g., the strip 130, having a triangular cross-section. The suppressor 106 is configured to reflect incoming near-field radiated energy (represented by a line 168), here having flat surfaces 150, 152 that may efficiently reflect incoming near-field radiated energy from a radiator 104. The ground plane 120 is displaced from the planar array 102 in a first direction, while the suppressor 106 extends away from the planar array 102 in a second direction, opposite the first direction (here, with the surfaces 150, 152 extending partially in the second direction). The surface 150 is particularly configured to at least partially reflect the near-field energy (represented by the line 168) radiated by the radiator $\mathbf{104}_1$ to inhibit this energy from reaching and coupling to the radiator $\mathbf{104}_2$ while the surface 152 is particularly configured to at least partially reflect near-field energy radiated by the radiator $\mathbf{104}_2$ to inhibit this energy from reaching and coupling to the radiator $\mathbf{104}_1$. Each of the surfaces 150, 152 has a respective bottom edge 154, 156 (see FIG. 4), with the respective surface 150, 152 extending from the bottom edge 154, 156 away from the plane 160 of the planar array 102 (e.g., containing tops of the radiators $\mathbf{104}_1$, $\mathbf{104}_2$) and extending away from the centerlines 162, 164 of the respective radiators $\mathbf{104}_1$, $\mathbf{104}_2$. A normal to each of the surfaces 150, 152 (e.g., a normal 153 to the surface 152) is directed away from the ground plane 120 and toward a nearest one of the radiators 104 (the radiator $\mathbf{104}_2$ for the normal 153). This is not to say that the normal 153 extends directly away from the ground plane 120 and directly toward the radiator $\mathbf{104}_2$, but at least partially away from the ground plane 120 and at least partially toward the radiator $\mathbf{104}_2$. The suppressor 106 extends away from the plane 160 by approximately a quarter wavelength or more of the radiated millimeter-wave energy, e.g., a peak 166 is at least a quarter of a wavelength above the plane 160. The peak 166 may be further from the plane, e.g., at least 30% of a wavelength, at least half of a wavelength, at least 75% of a wavelength, at least a wavelength, etc. While the surfaces 150, 152 are flat, other configurations with non-flat surfaces may be used and the cross-section of the suppressor 106 need not be triangular.

The suppressor 106 comprises a material, such as a dielectric, with a low permittivity value such that the suppressor 106 is an insulator. The suppressor 106 is configured such that most, if not all, near-field radiative millimeter-wave energy incident upon the suppressor 106 that is not reflected and that penetrates the suppressor 106 will be absorbed and not leave the suppressor 106, inhibiting if not preventing such energy from coupling to a neighbor radiator 104. The energy that does penetrate the suppressor 106 may polarize the suppressor 106.

As described above with respect to the antenna systems 62, 64, the array 102 may be implemented on the PCB 66, or may be implemented on another board mounted to the PCB 66. In such embodiments, the array 102 may be configured to radiate in a direction away from the display layer 54 of the mobile device 12, for example in a direction that is orthogonal to a back cover of the mobile device 12 or in a direction that is within a certain angle of orthogonal, for example up to 75 degrees in any direction from orthogonal. In some embodiments, the array 102 is implemented on a board that is angled with respect to the PCB 66, for example so as to radiate substantially out of a side 51, 57 of the mobile device 12.

Figure 6:
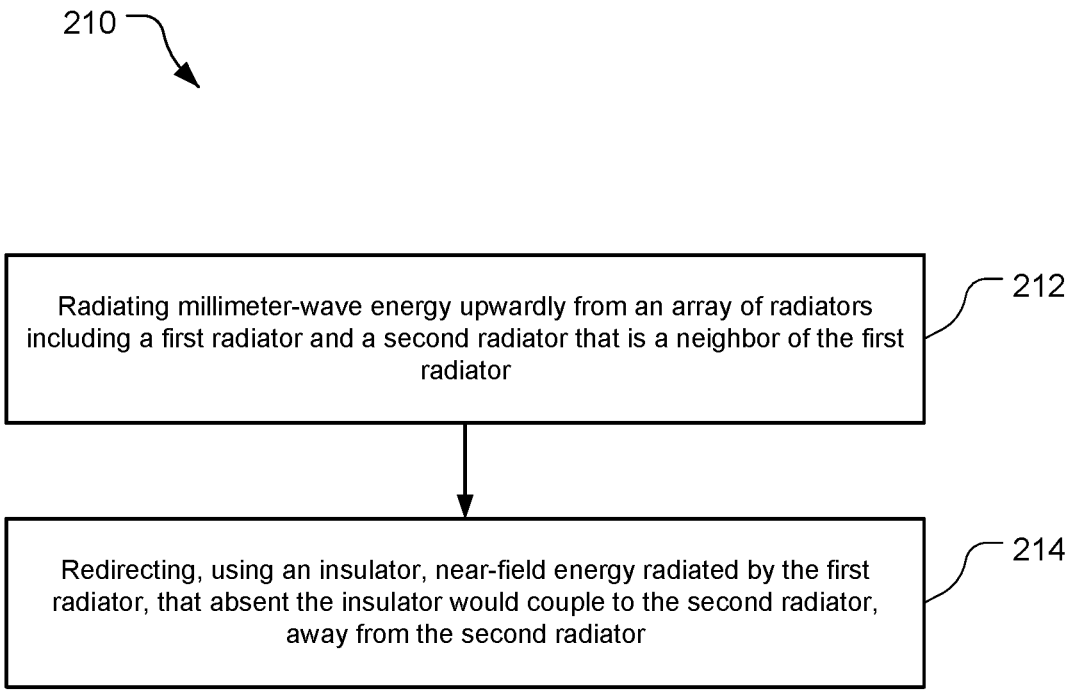
FIG. 6 is a block flow diagram of a method of reducing near-field coupling between radiators.

Referring to FIG. 6, with further reference to FIGS. 1-5, a method 210 of method of reducing near-field coupling between radiators includes the stages shown. The method 210 is, however, an example only and not limiting. The method 210 may be altered, e.g., by having one or more stages added and/or removed, by having stages rearranged, combined, and/or performed concurrently, and/or by having one or more single stages split into multiple stages.

At stage 212, the method 210 includes radiating millimeter-wave energy from an array of radiators including a first radiator and a second radiator that is a neighbor of the first radiator. For example, the planar array 102 of the radiators 104 shown in FIG. 4, and in particular the radiators $\mathbf{104}_1$, $\mathbf{104}_2$ shown in FIG. 5, radiate millimeter-wave energy away from the ground plane 120. Absent a mechanism in addition to the radiators 104, the radiators 104 will couple to each other, and in particular neighbor radiators 104 will couple near-field energy to each other.

At stage 214, the method 210 includes redirecting, using an insulator, near-field energy radiated by the first radiator, that absent the insulator would couple to the second radiator, away from the second radiator. For example, the near-field suppressor 106, disposed between neighbor radiators 104, reflects near field energy, e.g., the near-field energy represented by the line 168, radiated by the radiator $\mathbf{104}_1$ away from the radiator $\mathbf{104}_2$ to inhibit or prevent the near-field energy from the radiator $\mathbf{104}_1$ from coupling to the radiator $\mathbf{104}_2$. The suppressor 106 reflects at least some of the near-field energy radiated by the radiator $\mathbf{104}_1$ and incident upon the surface 152 of the suppressor 106, with the surface 152 being angled away from boresight of the radiator $\mathbf{104}_1$ as the surface 152 extends from a plane of the radiator $\mathbf{104}_1$.

The method 210 may include one or more further features. For example, the method 210 may include redirecting, using the insulator, near-field energy from the second radiator that absent the insulator would couple to the first radiator. For example, in addition to the surface 152 reflecting near-field energy from the radiator $\mathbf{104}_1$ from reaching the radiator $\mathbf{104}_2$, the surface 150 may reflect near-field energy from the radiator $\mathbf{104}_1$ from reaching the radiator $\mathbf{104}_2$. The same applies for other sets of neighbor radiators 104, e.g., all pairs of neighbor radiators in the planar array 102 (or other array) of the radiators 104 (or other radiator configuration).

OTHER CONSIDERATIONS

Also, as used herein, "or" as used in a list of items prefaced by "at least one of" or prefaced by "one or more of" indicates a disjunctive list such that, for example, a list of "at least one of A, B, or C," or a list of "one or more of A, B, or C" means A or B or C or AB or AC or BC or ABC (i.e., A and B and C), or combinations with more than one feature (e.g., AA, AAB, ABBC, etc.).

The systems and devices discussed above are examples. Various configurations may omit, substitute, or add various procedures or components as appropriate. For instance, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. Further, some items have been shown without unnecessary detail in order to avoid obscuring the configurations. This description provides example configurations only, and does not limit the scope, applicability, or configurations of the claims. Rather, the preceding description of the configurations provides a description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of operations may be undertaken before, during, or after the above elements are considered. Accordingly, the above description does not bound the scope of the claims.

Further, more than one invention may be disclosed.

The invention claimed is:

1. A millimeter-wave antenna system comprising:

an array of radiators comprising a first radiator and a second radiator, each of the first radiator and the second radiator being configured to radiate millimeter-wave energy; and an insulator disposed at least partially between the first radiator and the second radiator and disposed and configured to intercept first near-field energy radiated by the first radiator to inhibit the first near-field energy from being received by the second radiator, and to intercept second near-field energy radiated by the second radiator to inhibit the second near-field energy from being received by the first radiator, the insulator being configured to reflect the first near-field energy away from the first radiator and away from the second radiator and to reflect the second near-field energy away from the first radiator and away from the second radiator.

2. The system of claim 1, wherein the insulator comprises a first surface having a first bottom edge and a second surface having a second bottom edge, the first surface extending from the first bottom edge away from a plane connecting a top of the first radiator and a top of the second radiator and extending away from a center of the first radiator, the second surface extending from the second bottom edge away from the plane connecting the top of the first radiator and the top of the second radiator and extending away from a center of the second radiator.

3. The system of claim 2, wherein the first surface is flat and the second surface is flat.

4. The system of claim 2, wherein the first surface extends away from the plane by a least a quarter of a wavelength of the millimeter-wave energy.

5. The system of claim 1, wherein the first radiator extends a first length transverse to a center-to-center direction between a center of the first radiator and a center of the second radiator, wherein the second radiator extends a second length transverse to the center-to-center direction, and wherein the insulator extends, transverse to the center-to-center direction, at least half of the first length and at least half of the second length.

6. The system of claim 1, wherein the insulator overlaps a projection of the first radiator, along boresight of the first radiator, by less than half of an area of the projection.

7. The system of claim 6, wherein the insulator overlaps none of the projection of the first radiator along boresight of the first radiator.

8. The system of claim 1, wherein the array of radiators comprises an array of patch radiators, the system further comprising a ground plane displaced from and disposed below the array of patch radiators, and wherein the insulator extends above the array of patch radiators.

9. The system of claim 8, wherein the array of patch radiators comprises a plurality of rows of the patch radiators and a plurality of columns of the patch radiators, and wherein the insulator comprises at least a first strip of dielectric material disposed between two of the plurality of rows of the array of patch radiators and at least a second strip of dielectric material disposed between two of the plurality of columns of the array of patch radiators.

10. The system of claim 1, wherein the first radiator and the second radiator have a center-to-center spacing of less than a half of a wavelength of the millimeter-wave energy.

11. A millimeter-wave antenna system comprising:

an array of planar radiators arranged in at least one row, each of the planar radiators being configured to radiate millimeter-wave energy;

a ground plane displaced from the array of planar radiators in a first direction; and a suppressor comprising a respective strip of dielectric disposed between each pair of neighbor radiators of the array of planar radiators;

wherein each strip of dielectric extends in a second direction away from the array of planar radiators, the second direction being opposite the first direction.

12. The system of claim 11, wherein each strip of dielectric includes a plurality of flat surfaces, a normal to each of the plurality of flat surfaces being directed away from the ground plane and toward a volume above a nearest one of the array of planar radiators.

13. The system of claim 11, wherein the array of planar radiators are arranged in a plurality of rows and a plurality of columns, and wherein the suppressor comprises the respective strip of dielectric disposed between each pair of neighbor radiators of neighboring rows of the array of planar radiators and between each pair of neighbor radiators of neighboring columns of the array of planar radiators.

14. The system of claim 13, wherein the suppressor comprises a grid of the dielectric.

15. The system of claim 11, wherein each strip of dielectric extends, along a plane of the planar radiators, at least half of a length of a nearest edge of each neighbor radiator of a respective pair of neighbor radiators.

16. The system of claim 11, wherein the suppressor is configured to inhibit near-field coupling between each pair of neighbor radiators.

17. A method of reducing near-field coupling between radiators, the method comprising:

radiating millimeter-wave energy from an array of radiators including a first radiator and a second radiator that is a neighbor of the first radiator; and redirecting, using an insulator, near-field energy radiated by the first radiator, that absent the insulator would couple to the second radiator, away from the second radiator.

18. The method of claim 17, wherein the redirecting comprises reflecting at least some of the near-field energy from a surface of the insulator that is angled away from boresight of the first radiator.

19. The method of claim 18, wherein the near-field energy is first near-field energy, and the surface of the insulator is a first surface of the insulator, the method further comprising redirecting, using the insulator, second near-field energy radiated by the second radiator, that absent the insulator would couple to the first radiator, away from the first radiator by reflecting at least some of the second near-field energy from a second surface of the insulator that is angled away from boresight of the second radiator.

20. The method of claim 17, wherein the array of radiators comprises a two-dimensional array of radiators, and wherein the redirecting comprises redirecting near-field energy radiated by each radiator of the array of radiators away from each neighbor radiator of the array of radiators using the insulator.

21. A millimeter-wave antenna system comprising:

a planar array of radiators arranged in at least one row, each of the radiators being configured to radiate millimeter-wave energy, the planar array of radiators including a first radiator and a second radiator that is neighbor of the first radiator; and means for redirecting near-field energy radiated by the first radiator, that absent the means for redirecting would couple to the second radiator, away from the second radiator.

22. The system of claim 21, wherein the means for redirecting comprises a wedge-shaped dielectric.

23. The system of claim 22, wherein the means for redirecting extends at least a quarter of a wavelength, at a frequency of the millimeter-wave energy, away from a plane of the planar array of radiators.

24. The system of claim 21, wherein the means for redirecting extends, along a plane of the planar radiators, at least half of a length of a nearest edge of each neighbor radiator of a respective pair of neighbor radiators of the planar array of radiators.

* * * * *